United States Patent [19]

Takigawa et al.

[11] Patent Number: 4,538,164

[45] Date of Patent: Aug. 27, 1985

[54] HEAT-SENSITIVE TRANSFER MEDIUM

[75] Inventors: Nobuhiro Takigawa; Hideo Watanabe; Kanzirou Kawasaki, all of Numazu; Keishi Kubo, Yokohama; Minoru Hakiri; Eiichi Kawamura, both of Numazu, all of Japan

[73] Assignee: Ricoh Co., Ltd., Tokyo, Japan

[21] Appl. No.: 675,911

[22] Filed: Nov. 28, 1984

[30] Foreign Application Priority Data

Nov. 30, 1983 [JP] Japan ..... 58-226470

[51] Int. Cl.[3] ..... B41M 5/18

[52] U.S. Cl. ..... 346/209; 346/207; 346/208; 427/150; 427/151

[58] Field of Search ..... 346/207, 208, 209, 225; 427/150, 151, 152

[56] References Cited

U.S. PATENT DOCUMENTS 4,480,052 10/1984 Ichijima et al. ..... 346/208

*Primary Examiner*—Bruce H. Hess

*Attorney, Agent, or Firm*—Flynn, Thiel, Boutell & Tanis

[57] ABSTRACT

This invention relates to a heat-sensitive transfer medium comprising a transfer sheet having a transfer layer containing a leuco dye as the main component and a receiving sheet having a receiving layer containing a developer for said leuco dye as the main component, characterized in that said receiving layer contains porous filler having an oil absorption amount of at least 50 ml/100 g and a phenolic compound expressed by the general formula,

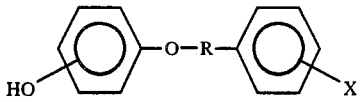

wherein R represents an alkylene group and X represents hydrogen or a halogen atom.

6 Claims, No Drawings

HEAT-SENSITIVE TRANSFER MEDIUM

BACKGROUND OF THE INVENTION

The present invention relates to a heat-sensitive transfer medium utilizing a color-forming reaction between a leuco dye and a developer therefor. More particularly, the present invention relates to a heat-sensitive transfer medium which is capable of producing a high density transfer image by a minute energy and further producing uniform density transfer images even when the transfer operation is repeated a large number of times.

As conventional heat-sensitive transfer mediums, there are known one comprising a combination of a transfer sheet having a thermo-sublimating dye layer on a substrate with a receiving sheet receiving a thermo-sublimating due image from the back side of said transfer sheet by thermal printing, and one comprising a combination of a transfer sheet having a transfer layer containing a heat fusible substance and a chromatogenous agent (dye or pigment) on a substrate with a receiving sheet.

However, the former heat-sensitive transfer medium using the thermo-sublimating dye is defective in that the dye image formed on the receiving sheet is inferior in preservability and therefore an overcoat must be applied on the transferred image, while the latter heat sensitive transfer medium using the transfer sheet having the transfer layer formed by dispersing dye or pigment in the heat-fusible substance is defective in that when a large amount of the chromatogenous agent is incorporated in the transfer layer in order to obtain high density images, the transfer efficiency deteriorates, and consequently it is difficult to obtain high density images, and further when a large amount of heat fusible substance is used in the transfer layer in order to raise a heat-sensitivity, said large amount of heat fusible substance transfers to the receiving sheet side, and consequently when stripping the transfer sheet of the receiving sheet, it is not stripped smoothly and the fine-lined up image area becomes indistinct.

On the other hand, there is also known a heat-sensitive transfer medium wherein substances thermally reactive each other to bring out color are respectively carried on separate substrates and the substances are brought into contact for being thermally printed. However, the heat-sensitive transfer medium of this type can be observed defective in that due to its reactive type, a sufficient color-forming reaction can not be carried out in case the transfer layer is merely transferred to the receiving layer at the time when the surfaces of both layers contact, so that the low density images may be produced, and that in case the thermo-printing is carried out for a long period of time under the elevated heating condition, the density of the image on the receiving sheet becomes higher, but on the other hand the color forming reaction progresses also on the transfer sheet thereby to form undesired images.

We proposed that a receiving layer on a receiving sheet should contain porous fillers having a large oil absorption amount to provide an improved heat/sensitive transfer medium having no defects as mentioned above (see Japanese Patent Application No. 57-139347). However, this medium is still unsatisfactory in respect of the stability of images and the density of images although images of a relatively high density can be obtained by repeatedly transferring a large number of times.

SUMMARY OF THE INVENTION

An object of the present invention is to provide a heat-sensitive transfer medium capable of producing a stable high density transfer image by a minute energy and further producing uniform density transfer images even when the transfer operation is repeated a large number of times. The heat-sensitive transfer medium of the present invention not only produces an excellent image stability but also provides a satisfactory reproducibility of the middle part of density gradation (half tone).

More particularly, the object of the present invention is to provide a heat-sensitive transfer medium comprising a transfer sheet having a transfer layer containing a leuco dye as the main component and a receiving sheet having a receiving layer containing a developer for said leuco dye as the main component, characterized in that said receiving layer contains porous filler having an oil absorption amount of at least 50 ml/100 g and a phenolic compound expressed by the general formula,

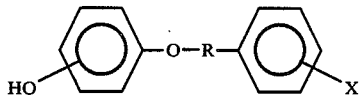

wherein R represents an alkylene group and X represents hydrogen or a halogen atom.

DETAILED DESCRIPTION OF THE INVENTION

According to the present invention, there is provided a heat-sensitive transfer medium comprising a transfer sheet having a transfer layer containing a leuco dye as the main component and a receiving sheet having receiving layer containing a developer for said leuco dye as the main component, characterized in that said receiving layer contains porous filler having an oil absorption amount of at least 50 ml/100 g and a phenolic compound expressed by the general formula,

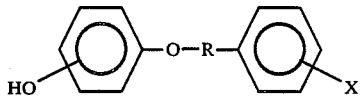

wherein R represents an alkylene group preferably having a carbon number of 1 to 8 and X represents hydrogen or a halogen atom, usually chlorine.

Examples of the phenolic compound include:
(4-hydroxyphenyl)-benzylether,
(4-hydroxyphenyl)-phenethylether,
(4-hydroxyphenyl)-(3-phenylpropyl)-ether,
(2-hydroxyphenyl)-benzylether,
(2-hydroxyphenyl)-phenethylether,
(2-hydroxyphenyl)-(3-phenylpropyl)-ether,
(3-hydroxyphenyl)-(4-chlorobenzyl)-ether and the like.

According to the present invention, a receiving sheet is superposed on a transfer sheet in such a manner as that a receiving layer is brought into contact with a transfer layer, and a desired colored image is formed on the surface of the receiving sheet by applying thermal printing on the backside of the transfer sheet or the receiving sheet. A high density transfer image can be obtained by a minute energy since the receiving layer contains a phenolic compound having the above mentioned general formula, a developer and a porous filler having an oil absorption amount of at least 50 ml/100 g. The stability of this transferred image is excellent and the image density does not change at all in process of time. The density of a transferred image obtained by using the conventional developer only is lowered during preservation, but the density of an image obtained on the receving layer containing the phenolic compound of the above mentioned general formula does not change at all in process of time. In accordance with the present invention, a porous filler enables the transfer of leuco dye from the transfer layer to the receiving layer smoothly little by little in proportion to the transferring conditions, and a large number of copies can be obtained with the same transfer sheet by exchanging a receiving sheet only.

The transfer sheet used in the present invention is prepared by applying a transfer layer containing a leuco dye as the main component on a substrate such as paper, synthetic paper, plastic film and the like.

As the leuco dye referred to herein, there may be employed any one which has usually been used in a pressure sensitive paper or heat sensitive paper, and for instance those of triphenylmethane type, fluoran type, phenothiazine type, Auramine type and spiropyran type are suitably used. Examples of preferably leuco dyes include:

3,3-bis(p-dimethylaminophenyl)-phthalide,
3,3-bis(p-dimethylaminophenyl)-6-dimethylaminophthalide (another name: Crystal Violet lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-(N-(3'-trifluoromethylphenyl)amino)-6-diethylaminofluoran,
2-(3,6-bis(diethylamino)-9-(o-chloroanilino)xanthyl benzoic acid lactam),
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco Methylene Blue,
6'-chloro-8'-methoxy-benzoindolino-pyrilospiran,
6'-bromo-3'-methoxy-benzoindolino-pyrilospiran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide, and
3-(2'-methoxy-4'-dimethylaminophenyl)-3-(2'-hydroxy-4'-chloro-5'-methylphenyl)phthalide.

In the present invention, said leuco dye is used in an amount of 0.3–30 g/m$^2$, preferably 0.5–20 g/m$^2$ on a substrate. The receiving sheet used in the present invention has a receiving layer containing a developer for said leuco dye, a phenolic compound of the above general formula and porous filler as the main components on a substrate such as paper, synthetic paper, plastic film or the like.

As the developer referred to herein, there may be used an electron-receiving substance, for instance a phenolic substance, an organic acid or its salt or ester or the like. From a practical view point, the electron-receiving substance having a melting point of 200° C. or less is preferably applicable. Examples of developers preferably used in the present invention are shown below. In this connection, it is to be noted that the numerals enclosed with brackets denote melting points.

4-t-butylphenol(98),
4-hydroxydiphenyl ether(84),
1-naphthol(98),
2-naphthol(121),
methyl-4-hydroxy benzoate(131),
4-hydroxyacetophenone(109),
2,2'-dihydroxydiphenylether(79),
4-phenylphenol(166),
4-t-octylcatechol(109),
2,2'-dihydroxydiphenyl(103),
4,4'-methylenebisphenol(160),
2,2'-methylenebis(4-chlorophenol)(164),
2,2'-methylenebis(4-methyl-6-t-butylphenol)(125),
4,4'-isopropylidenediphenol(156),
4,4'-isopropylidenebis(2-chlorophenol)(90),
4,4'-isopropylidenebis(2,6-dibromophenol)(172),
4,4'-isopropylidenebis(2-t-butylphenol)(110),
4,4'-isopropylidenebis(2-methylphenol)(136),
4,4'-isopropylidenebis(2,6-dimethylphenol)(168),
4,4'-s-butylidenediphenol(119),
4,4'-s-butylidenebis(2-methylphenol)(142),
4,4'-cyclohexylidenediphenol(180),
4,4'-cyclohexylidenebis(2-methylphenol)(184),
salicylic acid(163), metatolyl salicylate(74),
phenacyl salicylate(110),
methyl4-hydroxybenzoate(131),
ethyl4-hydroxybenzoate(116),
propyl4-hydroxybenzoate(98),
isopropyl4-hydroxybenzoate(86), butyl4-hydroxybenzoate(71),
isoamyl4-hydroxybenzoate(50),
phenyl4-hydroxybenzoate(178),
benzyl4-hydroxybenzoate(111),
cyclohexyl4-hydroxybenzoate(119),
5-hydroxysalicylic acid(200),
5-chlorosalicylic acid(172),
3-chlorosalicylic acid(178),
thiosalicylic acid(164),
2-chloro-5-nitrobenzoic acid(165),
4-methoxyphenol(53),
2-hydroxybenzylalcohol(87),
2,5-dimethylphenol(75),
benzoic acid (122),
orthotoluic acid(107),
metatoluic acid(111),
paratoluic acid(181),
orthochlorobenzoic acid(142), metaoxybenzoic acid(200),
2,4-dihydroxy-acetophenone(97), resorcinol monobenzoate(135),
4-hydroxybenzophenone(133),
2,4-dihydroxybenzophenone(144),
2-naphthoicacid(184),
1-hydroxy-2-naphthoic acid(195),
ethyl 3,4-dihydroxybenzoate(128),
phenyl 3,4-dihydroxybenzoate(189),
4-hydroxypropiophenone(150),
salicylsalicylate(148),
monobenzyl phthalate(107),
1,1-bis(4'-hydroxyphenyl)methane,
1,1-bis(4'-hydroxyphenyl)ethane,
1,1-bis(4'-hydroxyphenyl)propane,
1,1-bis(4'-hydroxyphenyl)hexane,
1,1-bis(4'-hydroxyphenyl)heptane,
1,1-bis(4'-hydroxyphenyl)-2-propylpentane,
1,1-bis(4'-hydroxyphenyl)-2-ethylhexane,
2,2-bis(4'-hydroxyphenyl)octane,
2,2-bis(4'-hydroxyphenyl)propane,
2,2-bis(4'-hydroxyphenyl)hexane,
2,2-bis(4'-hydroxyphenyl)hepatane,
3,3-bis(4'-hydroxyphenyl)hexane,
1,1-bis(3'-methyl-4'-hydroxyphenyl)ethane,
1,1-bis(3'-methyl-4'-hydroxyphenyl)propane,
1,1-bis(3'-methyl-4'-hydroxyphenyl)butane,
1,1-bis(3'-methyl-4'-hydroxyphenyl)pentane,
1,1-bis(3'-methyl-4'-hydroxyphenyl)hexane,
1,1-bis(3'-methyl-4'-hydroxyphenyl)heptane,
2-(3'-methyl-4'-hydroxyphenyl)-2-(4'-hydroxyphenyl) propane,
2,2-bis(3'-methyl-4'-hydroxyphenyl)pentane,
2,2-bis(5'-methyl-4'-hydroxyphenyl)hexane,
2,2-bis(3'-methyl-4'-hydroxyphenyl)4-methylpentane,
1,1-bis(3'-methyl-4'-hydroxyphenyl)4'-methylbutane,
3,3-bis(3'-methyl-4'-hydroxyphenyl)pentane,
3,3-bis(3'-methyl-4'-hydroxyphenyl)hexane,
5,5-bis(3'-methyl-4'-hydroxyphenyl)nonane,
2-(4'-hydroxyphenyl)-2-(3'-chloro-4'-hydroxyphenyl)-propane,
2,2-bis(3'-isopropyl-4'-hydroxyphenyl)propane,
2,2-bis(3'-t-butyl-4'-hydroxyphenyl)propane,
2,2-bis(3'-chloro-4'-hydroxyphenyl)propane,
2-(4'-hydroxy-3',5'-dimethylphenyl)-2-(4'-hydroxy-phenyl)propane,
bis(3'-methyl-5'-ethyl-4'-hydroxyphenyl)methane,
1,1-(3'-methyl-5'-butyl-4'-hydroxyphenyl)butane,
bis(4-hydroxyphenylmercapto)methane(55),
1,2-bis(4-hydroxyphenylmercapto)ethane(173),
1,3-bis(4-hydroxyphenylmercapto)propane(82),
1,4-bis(4-hydroxypehnylmercapto)butane(182),
1,5-bis(4-hydroxyphenylmercapto)pentane(98),
1,6-bis(4-hydroxyphenylmercapto)hexane(166),
1,3-bis(4-hydroxyphenylmercapto)acetone(74),
1,5-bis(4-hydroxyphenylmercapto)-3-oxapentane(93),
1,7-bis(4-hydroxyphenylmercapto)-3,5-dioxaheptane(108), and
1,8-bis(4-hydroxyphenylmercapto)-3,5-dioxaoctane(100).

A phenolic compound of the above mentioned general formula is used in an amount of 0.3–30 parts by weight, preferably 0.5–15 parts by weight to 1 part by weight of the conventional developer. If the amount of the phenolic compound is less than the above mentioned value, the stability of a transfer image concerning the change in process of time is not satisfactory.

A porous filler used in a receiving layer of the receiving sheet of the present invention should have an oil absorption amount of at least 50 ml/100 g (JIS K5101 Method), preferably at least 150 ml/100 g. If the oil absorption amount of the porous filler used is less than 50 ml/100 g, the desired effect of the present invention can not be effected. An amount of the porous filler used in the receiving layer is 0.05–10 parts by weight to 1 part by weight of a developer. A preferable amount of the porous filler to obtain a satisfactory sensitivity and uniform transfer image density is 0.1–3 parts by weight.

Examples of a porous filler include inorganic and organic fine powders such as silica, aluminum silicate, alumina, aluminum hydroxide, magnesium hydroxide, urea-formaldehyde resin, styrene resin and the like.

The porous filler having an oil absorption amount of at least 50 ml/100 g may be included also in a transfer layer in order that a uniform satisfactory transfer image density can be obtained even when the transfer medium is repeatedly used a large number of times. An amount of the porous filler added to the transfer layer is 0.01–1 part by weight, preferably 0.03–0.5 part by weight to 1 part by weight of a leuco dye.

In the present invention, an appropriate amount of a heat-fusible substance having a melting point of not higher than 200° C., preferably not higher than 150° C. may be added to the receving layer and/or transfer layer for the purpose of enhancing the heat sensitivity.

A preferable example of the heat-fusible substance includes: amides such as lauric acid amide, caproic acid amide, palmitic acid amide, stearic acid amide, behenic acid amide, N-methylstearic acid amide, N-cyclohexylstearic acid amide, N-stearylbenzamide, N-stearylacetamide, or the like; and esters such as phenyl 4-hydroxybenzoate, 2-methoxyphenyl 4-hydroxybenzoate, 2-methoxyphenyl salicylate, 4-benzylphenyl benzoate, 4-methoxyphenyl benzoate, methyl 4-benzoyloxybenzoate, phenyl 4-benzoyloxybenzoate, 4-cyanophenyl benzoate or the like. However, the heat-fusible substance used in the present invention is not limited to the above mentioned compounds.

As a binder usable in the transfer layer and the receiving layer, there can be enumerated the usual ones such as water-soluble, organic solvent soluble or water emulsion-forming binder including, for instance, polyvinyl alcohol, methoxycellulose, hydroxyethylcellulose, carboxymethylcellulose, polyvinylpyrrolidone, polyacrylamide, polyacrylic acid, starch, gelatin, polystyrene, vinylchloride/vinylacetate copolymer, polybutylmethacrylate, and the like. In the case of transfer layer, it is particularly preferable to use a resin having a melting or softening point of 50°–130° C. such as polyethylene, polypropyrene, polystyrene, petroleum resin, acrylic resin, vinyl chloride resin, vinyl acetate resin, vinylidene chloride resin, polyvinylalcohol, cellulose resin, polyamide, polyacetal, polycarbonate, polyester, fluorine-containing resin, silicone resin, natural rubber, chlorinated rubber, butadiene rubber, olefin rubber, phenol resin, urea resin, melamine resin, epoxy resin, polyimide and the like.

The resin as mentioned above can be used as a homopolymer, copolymer or a mixture of plural resins. In particular, it is preferable to use those resins whose SP value (solubility parameter) is not less than 8, more preferably not less than 9. When using these resins as a binder to prepare a transfer sheet, the transfer layer forming solution can be coated in the form of a solvent solution, hot-melt or aqueous emulsion.

Said SP value denotes a solubility parameter of a resin, and is represented by the following formula:

SP value $(Cal/cc)^{\frac{1}{2}}=(E/V)^{\frac{1}{2}}$

E: coagulant energy density (Cal/mole) of resin

V: molar volume (cc/mole).

In order to furthermore enhance the heat sensitivity of the transfer medium of the present invention, the transfer layer and/or receiving layer containing the heat fusible substance are preferably subjected to heat treatment with a temperature more than the melting point of the heat fusible substance, thereby fusing the heat fusible substance once. In case where a transfer layer containing a leuco dye is formed, it is preferable to utilize a coating liquid containing the leuco dye in the state of fusion. It is also effective to control the surface smoothness (Beckmann's smoothness JIS-P8119) of the transfer layer and/or receiving layer to be in the range of 200–1000 seconds.

The transfer medium of the present invention can be obtained by preparing each layer-forming liquid by dispersing and/or solving each layer forming component in a solvent such as water and the like in a ball mill, attriter or the like, coating the layer-forming liquid on each substrate and drying in such a manner as to provide an adhered amount of 0.3–30 g/m$^2$ in dry state.

When preparing a transfer sheet, a transfer layer-forming solution may uniformly be applied on the whole part of the surface of a substrate to form the so-called plain cloth-like (non-image-wise) transfer layer. The non-image-wise transfer layer can be formed simply by uniformly coating a transfer layer-forming solution on the whole surface of a substrate. If desired, a transfer layer-forming solution may also be applied in such a manner as to form an image-wise transfer layer by making a desirable image-wise (including letters) coating. This image-wise coating can be effected by coating a transfer layer-forming solution on substrate by means of letterpress printing, gravure printing or other printing techniques. In another way, an image-wise transfer layer may be adhered to an appropriate substrate such as paper, synthetic paper, plastic film or the like by superposing the substrate onto the non-image-wise transfer layer of said transfer sheet and pressing the substrate side or the transfer sheet side in such a manner as to provide an image by pressing means such as a typewriter, steel pen and the like or heat-pressing means such as thermal head, thermal pen and the like.

According to the present invention, the heat transfer can be effected in the following manner. In the case of a transfer sheet having an image-wise transfer layer, the heat transfer is carried out by superposing a receiving sheet on the transfer layer of the transfer sheet in such a manner as to bring the receiving layer into contact with the transfer layer and passing them between hot rolls. On the other hand, in the case of a transfer sheet having a non-image-wise transfer layer, the heat transfer is effected by superposing the receiving layer of a receiving sheet on the transfer layer of the transfer sheet and directly heat-pressing the back side of the transfer sheet by means of a thermal printer or the like. In another way, the heat transfer is effected by superposing the receiving layer of the receiving sheet on the transfer layer of the transfer sheet, further superposing a manuscript having a black ink image on the back side of the transfer sheet in such a manner as to make an intimate contact and irradiating infrared ray from the side of the receiving sheet, thereby selectively heating the black image parts only of the manuscript. In this case, both the transfer sheet and the receiving sheet must be transparent to infrared ray.

According to the heat-sensitive transfer system of the present invention, a large number of copies can easily be obtained by repeating the above mentioned procedure with a single transfer sheet. In case of obtaining a multicolor copy, transfer sheets containing leuco dyes of different color tones are used. For example, if a transfer sheet containing a blue leuco dye and a transfer sheet containing a red leuco dye are used with the same receiving sheet, blue and red colored images are formed on the same receiving sheet.

DESCRIPTION OF THE PREFERRED EMBODIMENTS

The present invention is further illustrated by the following Examples. All "part" and "%" in the Examples are expressed by weight.

EXAMPLE 1

(1) Preparation of Transfer Sheet A

Crystal Violet lactone: 10 parts vinyl chloride/vinyl acetate copolymer resin: 2 parts methyl ethyl ketone: 88 parts The above composition was dispersed in a ball mill for 24 hours. The dispersed composition was coated on a polyester film of a thickness of 6 um having a rough surface by a wire bar, and the coated film was dried to prepare transfer sheet A having an adhered amount of 10 g/m$^2$.

(2) Preparation of Receiving Sheet B-1

(4-hydroxyphenyl)benzyl ether: 15 parts 1,5bis(4-hydroxyphenylmercapto)-3-oxapentane: 5 parts silica powder (oil absorption amount more than 200 ml/100 g): 8 parts vinylchloride/vinylacetate copolymer: 3 parts methyl cellosolve: 69 parts A receiving layer coating solution was prepared by dispersing the above composition in a ball mill for 24 hours. 50% emulsion liquid of styrene/butadiene rubber (minimum film-forming temperature MFT=50° C.) was coated on a fine paper (52 g/m$^2$) by a wire bar to form a pre-coat layer on the paper having an adhered amount of 2 g/m$^2$. The above prepared receiving layer coating solution was then coated on the pre-coated paper, and was dried to prepare receiving sheet B-1 having a receiving layer of an adhered amount of 5 g/m$^2$.

EXAMPLE 2

Receiving sheet B-2 was prepared by repeating the same procedure as in the preparation of receiving sheet B-1 of Example 1, except that (4-hydroxyphenyl)-(3-phenylpropyl)-ether was used as a developer in place of (4-hydroxyphenyl)benzyl ether.

EXAMPLE 3

Receiving sheet B-3 was prepared by repeating the same procedure as in the preparation of receiving sheet B-1 of Example 1, except that (3-hydroxyphenyl)-(4'-chlorobenzyl) ether was used as a developer in place of (4-hydroxyphenyl)benzyl ether.

COMPARATIVE EXAMPLE

Receiving sheet C-1 was prepared in the same manner as in Example 1, except that the following composition was used as a receiving layer coating solution.

1-5bis(4-hydroxyphenylmercapto)-3-oxapentane: 20 parts silica powder: 8 parts vinylchloride/vinylacetate copolymer: 3 parts methylcellosolve: 69 parts The above prepared transfer sheets were respectively brought into contact with the receiving layers of the receiving sheets. Thereafter, heat energies were applied on the back side of the transfer layers by a thermal head by three steps, for example, 0.9 mJ, 0.7 mJ and 0.5 mJ to measure the change in developed densities in the course of time. The image density was measured by a Macbeth RD-514 density meter.

The following Table shows the results of the change in the transferred image densities in the course of time.

TABLE

| | Applied Energy (mJ) | Change in image density in process of time | | | |
|---|---|---|---|---|---|
| | | 0* | 10 days | 20 days | 30 days |
| Example 1 | 0.9 | 1.75 | 1.70 | 1.67 | 1.67 |
| | 0.7 | 1.20 | 1.17 | 1.17 | 1.17 |
| | 0.5 | 0.67 | 0.75 | 0.80 | 0.80 |
| Example 2 | 0.9 | 1.55 | 1.48 | 1.45 | 1.45 |
| | 0.7 | 1.04 | 1.00 | 0.96 | 0.96 |
| | 0.5 | 0.49 | 0.57 | 0.58 | 0.58 |
| Example 3 | 0.9 | 1.54 | 1.50 | 1.48 | 1.48 |
| | 0.7 | 1.09 | 1.01 | 1.00 | 1.00 |
| | 0.5 | 0.59 | 0.73 | 0.76 | 0.76 |
| Comparative Example | 0.9 | 2.21 | 2.39 | 2.31 | 2.22 |
| | 0.7 | 1.76 | 2.32 | 2.49 | 2.45 |
| | 0.5 | 1.25 | 1.50 | 1.74 | 1.82 |

*immediately after printing

As can be seen from the above Table, the change in image density in the course of the product of the present invention is much less as compared with the Comparative Example. Furthermore, since the change in image density in the course of time of the product of the present invention is less and the image density is strictly proportional to the applied energy, the middle part of density gradation (half tone) can be satisfactorily reproduced by controlling applied energy. On the other hand, in the case of Comparative Example, the image density is largely changed in process of time, and is not proportional to applied energy. This means that it is almost impossible for the product of Comparative Example to satisfactorily reproduce half tone.

As can be seen the above Examples and Comparative Example, according to the present invention, a leuco dye and a developer therefor are respectively applied on separate substrates and there is therefore no problem with undesired coloring or development during production and/or storage. Moreover, since the non-image part of a printed copy has a developer only and no leuco dye is present there, the copy does not develop color when it is heated. That is, this is a complete fixing type.

The product of the present invention is furthermore excellent in heat sensitivity, and provides a high density image by a minute amount of heat energy.

Still further, a great number of copies can be produced by the same single transfer layer, thus providing an economical advantage, and the produced image density does not change in the course of time.

In addition to these advantages, the reproduction of half tone is excellent and the image density of each copy is completely uniform.

What is claimed is:

1. A heat-sensitive transfer medium comprising a transfer sheet having a transfer layer containing a leuco dye as the main component and a receiving sheet having a receiving layer containing a developer for said leuco dye as the main component, characterized in that said receiving layer contains porous filler having an oil absorption amount of at least 50 ml/100 g and a phenolic compound expressed by the general formula,

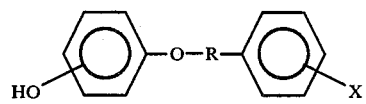

wherein R represents an alkylene group and X represents hydrogen or a halogen atom.

2. The heat-sensitive transfer medium according to claim 1, wherein said alkylene group of the phenolic compound has 1 to 8 carbon atoms, and X represents hydrogen or chlorine.

3. The heat-sensitive transfer medium according to claim 1, wherein said phenolic compound is used in an amount of 0.3 to 30 parts by weight per 1 part by weight of a developer.

4. The heat-sensitive transfer medium according to claim 1, wherein said phenolic compound is selected from the group consisting of
(4-hydroxyphenyl)-benzylether,
(4-hydroxyphenyl)-phenethylether,
(4-hydroxyphenyl)-(3-phenylpropyl)-ether,
(2-hydroxyphenyl)-benzylether,
(2-hydroxyphenyl)-phenethylether,
(2-hydroxyphenyl)-(3-phenylpropyl)-ether, and
(3-hydroxyphenyl)-(4-chlorobenzyl)-ether.

5. The heat-sensitive transfer medium according to claim 1, wherein said porous filler is used in an amount of 0.05 to 10 parts by weight per 1 part by weight of said developer.

6. The heat-sensitive transfer medium according to claim 1, wherein said porous filler is selected from the group consisting of silica, aluminum silicate, alumina, aluminum hydroxide, magnesium hydroxide, urea-formaldehyde resin, and styrene resin.

* * * * *